US009504891B1

(12) United States Patent
Chen

(10) Patent No.: US 9,504,891 B1
(45) Date of Patent: Nov. 29, 2016

(54) BASEBALL BAT

(71) Applicants: WELL JET INTERNATIONAL CO., LTD., Apia (WS); MIZUNO CORPORATION, Osaka-shi (JP)

(72) Inventor: Yung-Hsiung Chen, Apia (WS)

(73) Assignees: WELL JET INTERNATIONAL CO., LTD., Apia (WS); MIZUNO CORPORATION, Osaka-Shi (JP)

( * ) Notice: Subject to any disclaimer, the term of this patent is extended or adjusted under 35 U.S.C. 154(b) by 0 days.

(21) Appl. No.: 14/803,665

(22) Filed: Jul. 20, 2015

(51) Int. Cl.
*A63B 59/54* (2015.01)
*A63B 59/00* (2015.01)
*A63B 59/06* (2006.01)

(52) U.S. Cl.
CPC ..... *A63B 59/0092* (2013.01); *A63B 59/06* (2013.01); *A63B 59/54* (2015.10)

(58) Field of Classification Search
CPC ..... A63B 2102/18; A63B 59/50–59/58; A63B 2059/581; A63B 2209/581; A63B 2209/023; A63B 2102/182
USPC ..... 473/566, 567
See application file for complete search history.

(56) References Cited

U.S. PATENT DOCUMENTS

| | | | | |
|---|---|---|---|---|
| 6,997,826 | B2 * | 2/2006 | Sutherland | A63B 59/50 473/566 |
| 7,115,054 | B2 * | 10/2006 | Giannetti | A63B 59/50 473/567 |
| 7,442,135 | B2 * | 10/2008 | Giannetti | A63B 59/50 473/520 |
| 7,585,235 | B2 * | 9/2009 | Misono | A63B 59/50 473/566 |
| 2005/0202909 | A1 * | 9/2005 | Giannetti | A63B 59/50 473/567 |
| 2009/0215559 | A1 * | 8/2009 | McNamee | A63B 59/50 473/567 |
| 2013/0184107 | A1 * | 7/2013 | Epling | A63B 59/50 473/567 |

* cited by examiner

*Primary Examiner* — Mark Graham
(74) *Attorney, Agent, or Firm* — Muncy, Geissler, Olds & Lowe, P.C.

(57) ABSTRACT

The present invention proposes a baseball bat, which comprises a hollow handle region extending along an axis and including a connection section; and a barrel region extending along the axis and connected with the connection section. The barrel region has thermoset resin layers and at least one flexible chain polymer layer, which exists within the thermoset resin layers, so that the barrel region does not harden after shape forming. The barrel region of the baseball bat can absorb vibration during batting and improve the stability of the batted ball.

8 Claims, 4 Drawing Sheets

BASEBALL BAT

FIELD OF THE INVENTION

The present invention relates to a baseball instrument, particularly to a baseball bat whose barrel is not hardened after shape forming.

BACKGROUND OF THE INVENTION

The wooden baseball bats are generally used because they are inexpensive. However, a wooden bat is fragile and heavier. A wooden bat is laborious to swing, easy to break, inferior in batting performance, and likely to vibrate violently during batting and cause sport injury.

So far, a baseball bat whose barrel is mainly made of cured resin layers has been developed to overcome the abovementioned problems. As the barrel is fabricated via shape forming and resin curing, higher stress is likely to concentrate on the sweet spot of the barrel during batting, reducing the vibration absorption capability of the sweet spot and decreasing the stability of the batted ball. Therefore, this type of baseball bats lacks sufficient reliability.

SUMMARY OF THE INVENTION

One objective of the present invention is to solve the problem that the barrel of the conventional baseball bat is likely to harden after shaping forming. Thus, the present invention provides a baseball bat having higher damping capability and increasing the stability of the batted ball.

To achieve the abovementioned objective, the present invention proposes a baseball bat, which comprises a hollow handle region and a barrel region. The hollow handle region extends along an axis and includes a grip section and a connection section, which respectively extend oppositely from the joint thereof along the axis. The connection section has an outer diameter greater than that of the grip section. The barrel region is connected with the connection section and extends along the axis. The barrel region is mainly fabricated with thermoset resin layers with at least one flexible chain polymer layer thereinside and will not harden after shape forming.

Owing to the abovementioned unique design, the present invention is distinct from the conventional technology and has the following efficacies:

The barrel region of the baseball bat of the present invention has thermoset resin layers with at least one flexible chain polymer layer thereinside. Therefore, the strength of the barrel region is enhanced, and the durability of the baseball bat is increased. Further, the barrel region can effectively absorb vibration during batting the baseball and increase the stability of the batted ball.

DETAILED DESCRIPTION OF THE PREFERRED EMBODIMENTS

Below, embodiments are described in detail in cooperation with the attached drawings to make easily understood the objectives, technical contents, characteristics and accomplishments of the present invention.

Figure 1A:
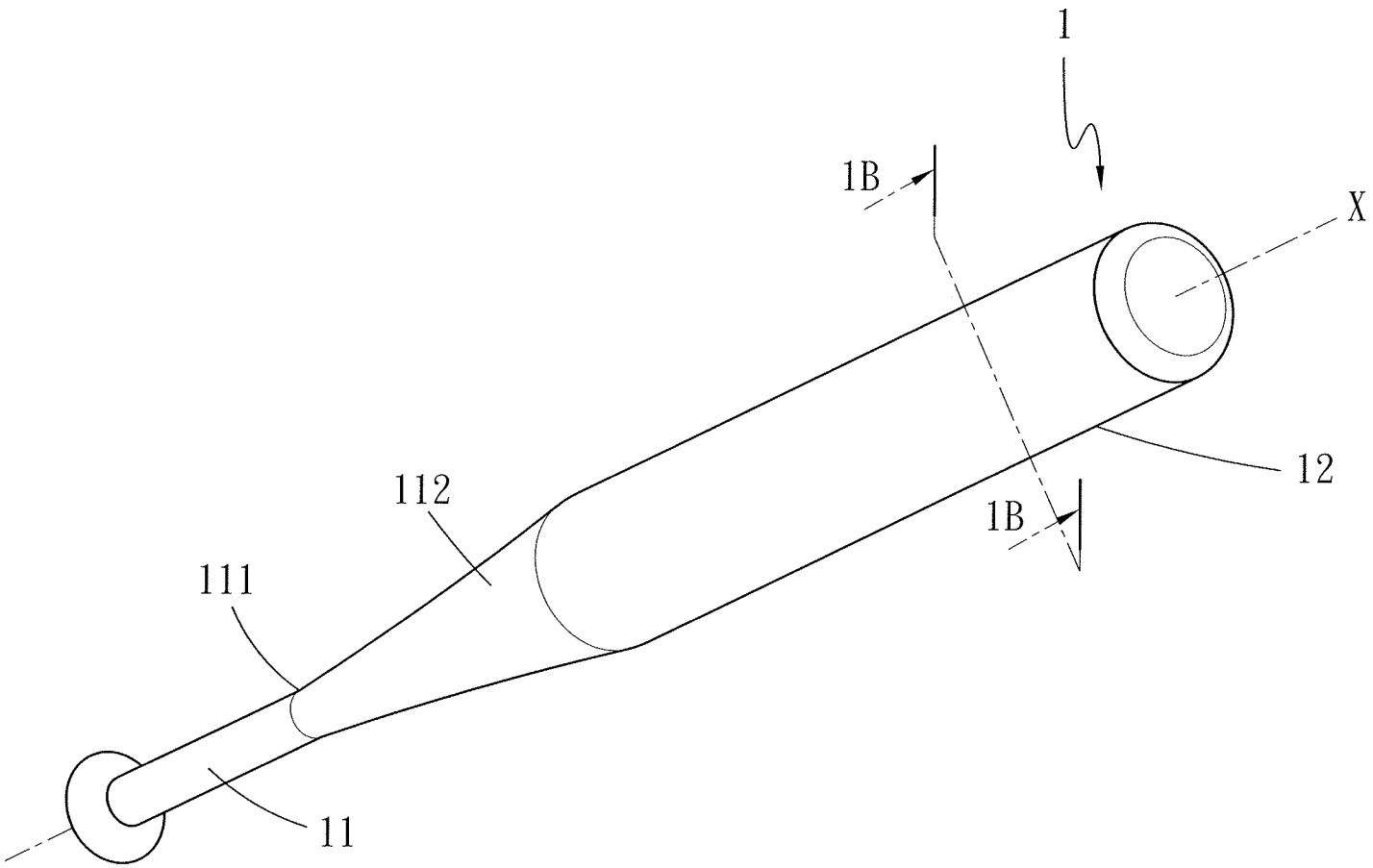
FIG. 1A is a perspective view schematically showing a baseball bat according to one embodiment of the present invention.
Figure 1B:
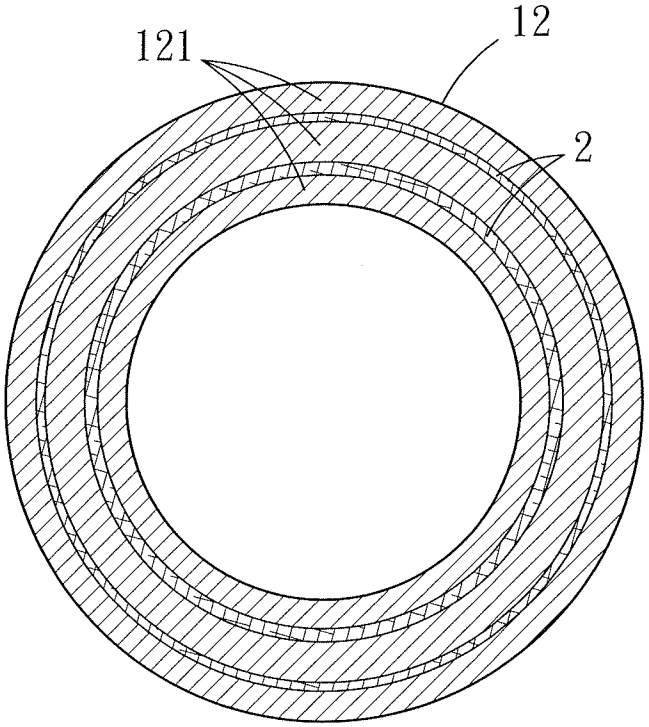
FIG. 1B is a sectional view taken along Line 1B-1B in FIG. 1A.
Figure 2:
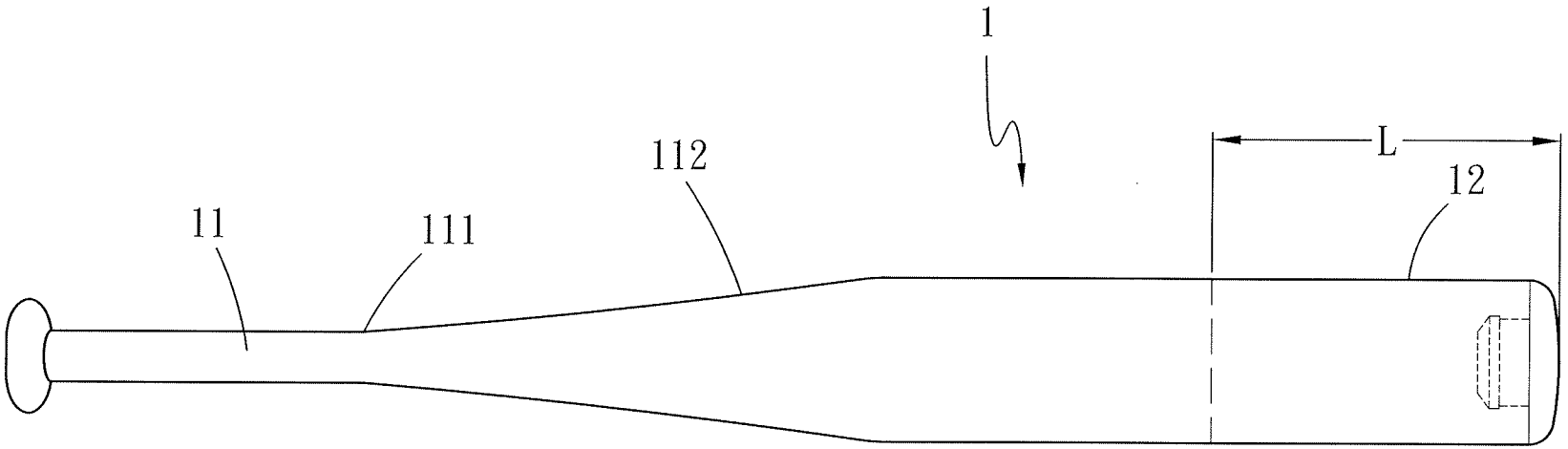
FIG. 2 is a front view schematically showing a baseball bat according to one embodiment of the present invention.

Refer to FIG. 1A, FIG. 1B and FIG. 2 for a preferred embodiment of the present invention. The baseball bat 1 of the present invention comprises a hollow handle region 11 and a barrel region 12.

The hollow handle region 11 extends along an axis X and includes a grip section (111) and a connection section (112), which respectively extend oppositely from the joint thereof along the axis X. The connection section (112) has an outer diameter greater than that of the grip section (111). The barrel region 12 extends along the axis X and is connected with the connection section (112). The barrel region 12 has at least one thermoset resin layer 121 and at least one flexible chain polymer layer 2, which exists within the thermoset resin layer 121 and does not harden after the barrel region 12 has been formed.

In the embodiment shown in FIG. 1A, FIG. 1B and FIG. 2, the barrel region 12 has two flexible chain polymer layers 2. The flexible chain polymer layer 2 is fabricated with a fabric composite, which is made of synthetic methyl acrylic acid polymer and carbon fiber (CF) or glass fiber (GF). The thermoset resin layer 121 of the barrel region 12 is fabricated with a fabric composite, which is made of epoxy resin and carbon fiber (CF) or glass fiber (GF) and hardened after shape forming. The weight ratio of the thermoset resin layer 121 and the flexible chain polymer layers 2 is adjusted to an appropriate value to make the barrel region 12 achieve a vibration absorption effect similar to a flax-containing composite material. The weight of the flexible chain polymer layer 2 of the barrel region 12 is 3%-50% of the weight of the baseball bat 1. The impact absorptivity of a normal fiber reinforced plastic plate is 10% of the impact strength. The impact absorptivity of the flexible chain polymer layer 2 is 60% of the impact strength and thus 6 times the impact absorptivity of the thermoset resin layer 121, almost equal to the impact absorptivity of rubber.

In one embodiment, the flexible chain polymer layer 2 is extended from the top of the barrel region 12 to have a length of at least 22% of the total length L of the baseball bat 1, wherein the flexible chain polymer layer 2 is fabricated with a fabric composite, which is made of synthetic methyl acrylic acid polymer and carbon fiber (CF) or glass fiber (GF).

In one embodiment, the flexible chain polymer layer 2 adopts a synthetic methyl acrylic acid polymer, which is similar to epoxy resin in flexibility and toughness and unlikely to harden after shape forming. In one embodiment, the flexible chain polymer layer 2 is fabricated with a fabric composite, which is made of synthetic methyl acrylic acid polymer and carbon fiber (CF) or glass fiber (GF), wherein rubber powder, carbon nanotubes, or carbon nano fullerene is further added to the fabric composite to enhance the durability of the barrel region 12.

In one embodiment, the hardness of the flexible chain polymer layer 2 is less than 60% of the hardness of the thermoset resin layer 121. The difference of the hardnesses of the thermoset resin layer 121 and the resin of the flexible chain polymer layer 2 is over 25 Shore Hardness (HS). Thereby is increased the comfort of holding the baseball bat and decreased the vibration caused by batting.

In one embodiment, the flexible chain polymer layer 2 has an optimized weight ratio of the reinforcing fiber and the synthetic methyl acrylic acid polymer 35-70: 65-30, wherein the reinforcing fiber of the flexible chain polymer layer 2 is carbon fiber (CF) or glass fiber (GF).

In one embodiment, the barrel region 12 has only a single flexible chain polymer layer 2.

Figure 3:
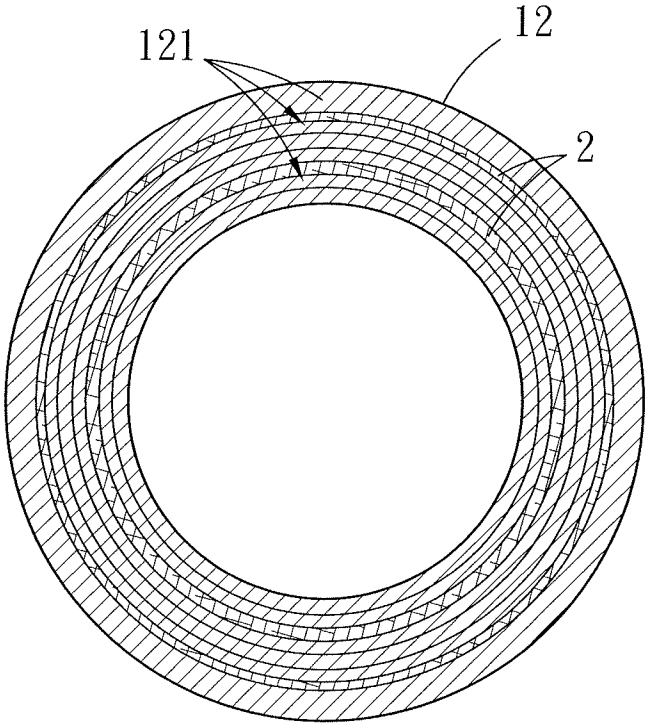
FIG. 3 is a sectional view schematically showing a barrel region having a plurality of thermoset resin layers according to one embodiment of the present invention.

Refer to FIG. 3. In one embodiment, the barrel region 12 has a plurality of thermoset resin layers 121.

According to the above discussion, the advantages of the baseball bat of the present invention are summarized as follows:

1. The strength and performance of the barrel region is enhanced via the cooperation of the thermoset resin layer and the flexible chain polymer layer, and the service life of the baseball bat is also prolonged.

2. The flexible chain polymer layers inside the barrel region decrease the weight of the overall weight of the baseball bat without reducing structural strength and make the barrel region not hardened after shape forming. Further, the flexible chain polymer layers promote comfort of holding the baseball bat and reduce vibration caused by batting the baseball.

The embodiments have been described above to enable the persons skilled in the art to understand, make, and use the present invention. However, these embodiments are only to exemplify the present invention but not to limit the scope of the present invention. Any equivalent modification or variation according to the shape, structure or characteristic of the present invention is to be also included within the scope of the present invention.

What is claimed is:

1. A baseball bat, comprising:

a hollow handle region, the hollow handle region extending along an axis and comprising a grip section and a connection section, which respectively extend oppositely from a joint thereof along the axis; and a barrel region, wherein the connection section has an outer diameter greater than that of the grip section, wherein the barrel region extends along the axis and is connected with the connection section, wherein the barrel region mainly includes thermoset resin layers and at least one flexible chain polymer layer arranged inside the thermoset resin layers to prevent the barrel region from hardening after shaping forming, wherein the at least one flexible chain polymer layer is made of a synthetic methyl acrylic acid polymer, wherein the at least one flexible chain polymer layer has reinforcing fiber, and wherein a weight ratio of the reinforcing fiber and the synthetic methyl acrylic acid polymer is 35-70:65-30.

2. The baseball bat according to claim 1, wherein the weight of the at least one flexible chain polymer layer is 3%-50% of the weight of the baseball bat.

3. The baseball bat according to claim 1, wherein an impact absorptivity of the at least one flexible chain polymer layer is 60% of an impact strength and 6 times of an impact absorptivity of the thermoset resin layers.

4. The baseball bat according to claim 1, wherein the at least one flexible chain polymer layer is extended from a top of the barrel region to have a length of at least 22% of a total length of the baseball bat.

5. The baseball bat according to claim 1, wherein the at least one flexible chain polymer layer is doped with rubber powder, carbon nanotubes, or carbon nano fullerene thereinside.

6. The baseball bat according to claim 1, wherein a hardness of the at least one flexible chain polymer layer is less than 60% of a hardness of the thermoset resin layers, and wherein a difference of the hardnesses of the thermoset resin layers and the at least one flexible chain polymer layer is over 25 Shore Hardness (HS).

7. The baseball bat according to claim 1, wherein the reinforcing fiber of the at least one flexible chain polymer layer is carbon fiber (CF) or glass fiber (GF).

8. The baseball bat according to claim 1, comprising multiple thermoset resin layers.

* * * * *